United States Patent [19]

Berry

[11] 4,249,858

[45] Feb. 10, 1981

[54] TURBINE WITH FREELY ROTATABLE ROTOR

[76] Inventor: Clyde F. Berry, R.F.D. 7, Box 169 C, Manchester, N.H. 03104

[21] Appl. No.: 101,581

[22] Filed: Dec. 10, 1979

Related U.S. Application Data

[63] Continuation-in-part of Ser. No. 923,001, Jul. 10, 1978, abandoned.

[51] Int. Cl.[3] ..... F01D 1/20; F01D 1/22

[52] U.S. Cl. ..... 415/64; 415/66; 415/68; 415/69

[58] Field of Search ..... 415/60, 64, 66–69

[56] References Cited

U.S. PATENT DOCUMENTS

| | | | |
|---|---|---|---|
| 802,025 | 10/1905 | Wagnor | 415/202 |
| 819,616 | 5/1906 | Stumpf | 415/202 |
| 910,170 | 1/1909 | Callan | 415/67 |
| 955,478 | 4/1910 | Seelye | 415/198.1 |
| 1,307,864 | 6/1919 | Jones | 415/65 |
| 2,276,695 | 3/1942 | Lavarello | 415/65 |
| 2,312,995 | 3/1943 | Anxionnaz | 415/68 |
| 2,434,678 | 1/1948 | Szczenlowski | 415/69 |
| 2,624,173 | 1/1953 | Bloomberg | 415/67 |
| 3,044,685 | 7/1962 | LaPiken | 415/60 |

*Primary Examiner*—William L. Freeh
*Attorney, Agent, or Firm*—C. Yardley Chittick

[57] ABSTRACT

A steam turbine having side by side rotors within the turbine housing, one rotor fixed to the turbine shaft and the other rotor free to rotate on the turbine shaft. The fixed rotor has a single set of vanes, the freely rotatable rotor has two sets of vanes, one set being adjacent the vanes of the fixed rotor and the other set adjacent a fourth set of vanes integral with the housing. One steam nozzle delivers steam against the vanes on the fixed rotor and a second steam nozzle delivers steam against the set of vanes on the second rotor that are adjacent the fixed vanes on the housing. The steam pressure is controlled so that steam from the nozzles will drive the fixed rotor and shaft at a selected speed which may be faster or slower than the speed of the freely rotatable rotor. The freely rotatable rotor may include reversely directed apertures permitting steam from the first nozzle to flow outwardly to act against the fixed vanes on the housing.

16 Claims, 9 Drawing Figures

TURBINE WITH FREELY ROTATABLE ROTOR

This application is a continuation-in-part of the application of Clyde F. Berry, Ser. No. 923,001 filed July 10, 1978, now abandoned, for Turbine With Freely Rotatable Rotor.

BACKGROUND OF THE INVENTION

In the steam turbine art, there may be a single rotor with peripheral vanes against which the steam, entering the housing in a tangential direction, is directed. Where there are a plurality of rotors, they are customarily secured in spaced relation along a common shaft with stationary steam reversing blades therebetween. The steam is thus directed successively to all of the rotors to make maximum use of the available energy.

As far as I am aware, the prior art does not disclose the practice of directing steam from two nozzles simultaneously at two side by side or overlapping rotors mounted on a common shaft within a housing where one rotor is keyed to the shaft and the other rotor is free to rotate on the shaft.

SUMMARY OF THE INVENTION

The object of the invention is to produce an acceptable power output from the available compressed driving fluid. The fluid is preferably steam and this term will be used throughout the specification hereinafter, it being understood, however, that any other suitable compressed gas could be used in place of steam.

The invention contemplates the use of two steam nozzles which will deliver steam against the vanes of two adjacent or overlapping rotors mounted on a common shaft within the turbine housing. One of the rotors is fixed or keyed to the shaft. The other rotor is mounted for free rotation on the shaft.

The fixed rotor has a single set of vanes. The free rotor has two sets of vanes, one set being adjacent the vanes of the fixed rotor and the other set being adjacent a set of fixed vanes arranged about the interior of the housing.

The housing and free rotor are so designed as to divide the housing interior into two circular spaces so that the steam from the first nozzle does not mingle directly with the steam from the second nozzle.

The steam from the first nozzle impinges directly on the vanes of the fixed rotor causing the rotor and shaft to rotate.

Steam from the second nozzle impinges directly on one of the sets of vanes on the free rotor, causing the free rotor to rotate on the shaft but not applying any driving force directly to the shaft. Whatever driving force is applied to the shaft must be applied by the fixed rotor.

It is my opinion that the rotation of the free rotor caused by the steam from the second nozzle directly engaging one set of vanes of the free rotor and expanding between these vanes and the fixed vanes on the housing augments the effectiveness of the steam from the first nozzle that is aimed at the vanes on the fixed rotor. That is, the steam from the first nozzle initially applies its kinetic energy to the vanes of the fixed rotor. Then this steam applies a continuing additional force to the fixed rotor as it expands in the space between the continuously advancing other set of vanes on the free rotor that are adjacent the vanes of the fixed rotor. In other words, the freely rotating rotor with its two sets of vanes serves as an intermediate means for transfering the driving force of the steam from the second nozzle to the fixed rotor.

In a modification of the invention, the freely rotating rotor contains a large number of ports spaced uniformly thereabout which extend diagonally rearwardly and outwardly from the inner vanes to the outer vanes whereby some of the higher pressure steam from the first nozzle can pass through the body of the free rotor to act against fixed vanes on the housing.

The foregoing explanation of the invention will be better understood as the description proceeds with the aid of the accompanying drawings in which FIG. 1 shows in vertical section one form of the invention with the bottom portion of the housing and rotors broken away to save space.

DESCRIPTION OF A FIRST EMBODIMENT OF THE INVENTION

Figure 1:
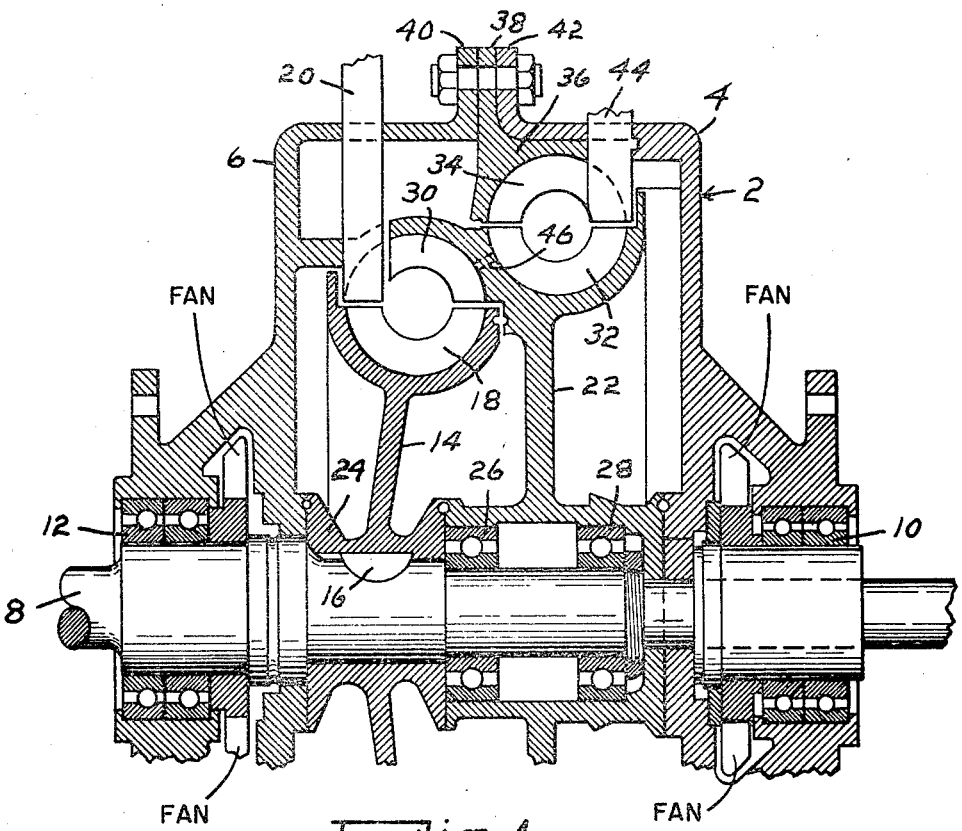

Referring to FIG. 1 there is shown a turbine 2 comprised of a housing made in two separable parts 4 and 6. The housing carries a shaft 8 mounted in bearings 10 and 12.

A first rotor 14 has its hub 24 secured to shaft 8 by key 16. The periphery of rotor 14 includes a first set of vanes 18, equally spaced about the rotor circumference.

A first steam nozzle 20 extends through the housing and is positioned to direct steam at vanes 18 and thus to cause rotation of rotor 14 and shaft 8. If desired or needed, there may be a plurality of steam nozzles directed at the vanes of rotor 14. When the term "steam nozzle" is used in the claims, it will be understood to include a plurality of steam nozzles.

A second rotor 22 is mounted on shaft 8, being supported for free rotation by any suitable bearing means 26. The axial dimensions of hub 24 of rotor 14 and hub 28 of rotor 22 are such that rotor 22 can rotate freely.

Rotor 22 has a set of vanes 30 which overhang and are closely adjacent the first set of vanes 18 of the fixed rotor 14. Vanes 30 will be referred to as the second set of vanes.

Rotor 22 also has another set of vanes 32 which, like vanes 18, are equally spaced about the rotor's outer circumference. Vanes 32 will be referred to as the third set of vanes.

Surrounding the third set of vanes 32 is a fourth set of vanes 34 which are mounted on a circular element 36 which as shown has a circular flange 38 which is secured between the two housing flanges 40 and 42.

A second steam nozzle 44 is arranged to enter the housing to direct steam at the third set of vanes 32 of free rotor 22. If desired or needed, a plurality of steam nozzles may be used to direct steam against vanes 32 of rotor 22.

It will be noted that the structure shown in FIG. 1 is such that steam from nozzle 20 is confined so that it acts solely on vanes 18 and 30. Likewise steam of nozzle 44 is confined so that it acts solely on vanes 32 and 34. There is no mingling of the steam from the two nozzles 20 and 44.

There are of course two exhaust ports (not shown) by which the spent steam leaves the housing to be used preferably for some purpose where heat is needed such as a heating system, for example. Alternatively the steam may go to a condenser from which the hot condensate may be returned to the steam boiler. The disposition of the used steam is however no part of the present invention.

When the turbine disclosed in FIG. 1 is put in operation, the steam volume from nozzle 20 will be greater than that from nozzle 44 as the latter acts against free rotor 22. The pressures will be adjusted so that, preferably, after the shaft is brought up to speed rotor 22 will rotate slower than rotor 14 but if desired the speed of rotor 22 could exceed that of rotor 14.

As previously mentioned, free rotor 22 acts as intermediate means for transferring steam power from nozzle 44 to the fixed rotor 14. It will be appreciated that the expanding steam from nozzle 20 will have greater driving effect against vanes 18 if the vanes 30 of rotor 22 are advancing in same direction, than would be the case if the vanes 30 were stationary. Thus even though rotor 22 is unconnected to shaft 8, nevertheless it acts through its rotation induced by the steam from nozzle 44 to add to the power output of rotor 14.

Ports 46 shown in dotted line in FIG. 1 running outwardly and rearwardly from the space between vanes 30 to the space between vanes 32 may be included whereby some of the high pressure steam from nozzle 20 may aid in the driving force by engagement with fixed vanes 34.

For best efficiency it has been determined that the speed of rotor 22 should not exceed that of rotor 14 although the turbine is fully operative when rotor 22 turns faster than rotor 14.

A SECOND EMBODIMENT OF THE INVENTION

Figure 2:
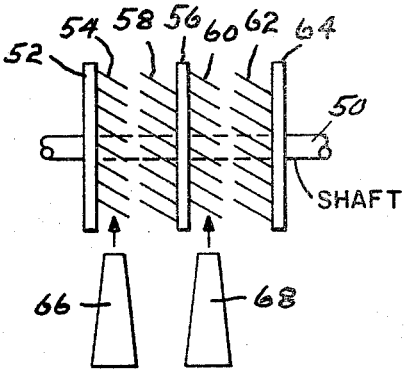
FIG. 2 is a schematic showing of a modification in which the vanes on the free rotor are located axially between the vanes of the fixed rotor and the vanes on the housing.

FIG. 2 is a schematic showing of another arrangement of the parts of the invention. In this drawing the housing is omitted but it will be understood that all of the parts shown would of course be contained within a conventional turbine housing.

The shaft 50 has mounted thereon a fixed rotor 52 having a first set of vanes 54 which extend from the side of the rotor rather than about the periphery. The rotor 56 mounted for free rotation on shaft 50 has a second set of vanes 58 which are closely adjacent vanes 54 of rotor 52.

Free rotor 56 also carries a third set of vanes 60 which are alongside a fourth set of stationary vanes 62 which are secured permanently to the housing part of which is indicated at 64.

A first steam nozzle 66 directs steam against vanes 54 and as the steam expands it acts between vanes 54 and the vanes 58 on the then rotating free rotor 56 to apply added force against vanes 54.

A second steam nozzle 68 has directed steam against vanes 60 of free rotor 56 to put the latter in rotation. The expanding steam from nozzle 68 acts between moving vanes 60 and fixed vanes 62 to accelerate rotor 56.

The net effect of this construction is the same as that of FIG. 1, namely to increase the power output of shaft 50.

A THIRD EMBODIMENT OF THE INVENTION

Figure 3:
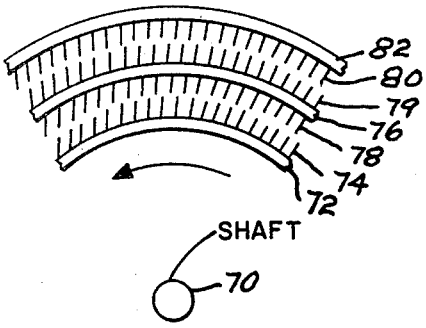
FIG. 3 is a schematic view of an arrangement basically the same as FIG. 1 but having the four sets of vanes in more exact radial alignment.

FIG. 3 shows a third form of the invention in schematic form. The housing has been omitted. This form differs from the construction of FIG. 2 in that the vanes instead of being side by side as in FIG. 2 or arranged in pairs as in FIG. 1 are arranged radially, one above the other.

The shaft 70 carries a fixed rotor 72 with vanes 74 about its periphery. Rotor 76 is mounted on shaft 70 so as to be freely rotatable thereon. Rotor 76 carries a second set of vanes 78 closely adjacent vanes 74 and a third set of vanes 79 on its outer periphery which latter vanes 79 are closely adjacent a fourth set of vanes 80 fixed to the housing 82.

There are two steam nozzles (not shown) which direct steam against the vanes 74 of fixed rotor 72 and against vanes 79 of free rotor 76. The operation is the same as that described with respect to FIGS. 1 and 2.

A FOURTH EMBODIMENT OF THE INVENTION

Figure 4:
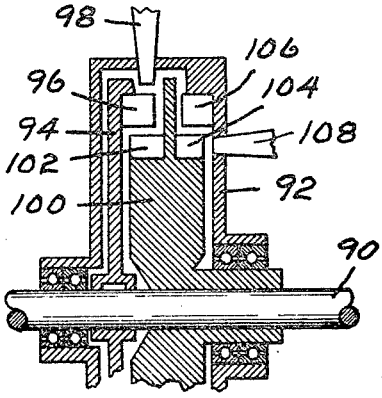
FIG. 4 is a vertical section to small scale of a modification in which the vanes on the free rotor are surrounded by the fixed rotor vanes and by the vanes on the housing.

FIG. 4 shows another form of the invention differing from FIGS. 1, 2 and 3 in the positioning of the vanes with respect to each other but capable of operating according to the principles previously explained.

Shaft 90 is mounted in housing 92. Rotor 94 is keyed to shaft 90. A first set of vanes 96 are located on rotor 94 so as to be engaged by steam from nozzle 98.

A second rotor 100 is mounted on shaft 90 in housing 92 so as to be freely rotatable with respect to the shaft.

Rotor 100 carries a second set of vanes 102 which are radially inside but closely adjacent vanes 96 of rotor 94. A third set of vanes 104 on rotor 100 are radially inside but closely adjacent a fourth set of vanes 106 mounted in fixed relation to the housing 92.

A second steam nozzle 108 directs steam at the third set of vanes 104 on free rotor 100.

The operation of this form of the invention is the same as that described above with respect to FIGS. 1 and 2.

A FIFTH EMBODIMENT OF THE INVENTION

Figure 5:
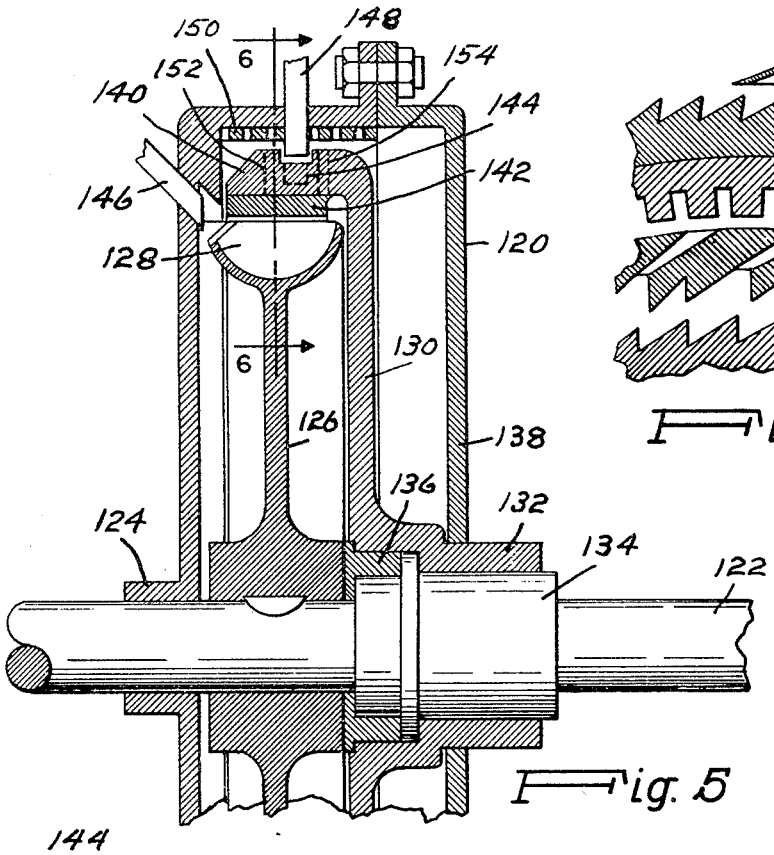
FIG. 5 shows a sectional view of another modification in which the free rotor has diagonal steam ports extending therethrough.
Figure 6:
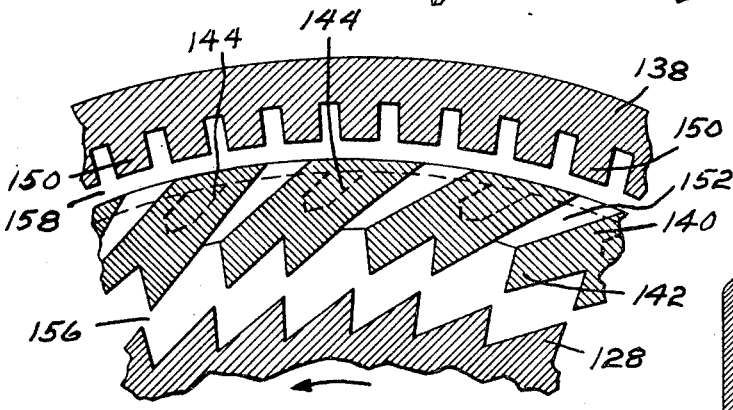
FIG. 6 is an enlarged fragmentary section taken on the line 6—6 of FIG. 5.
Figure 7:
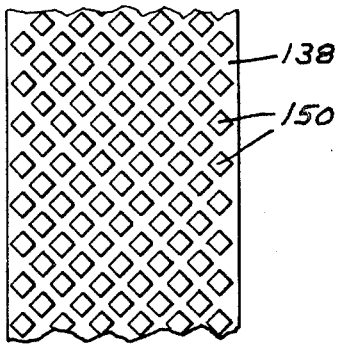
FIG. 7 is a fragmentary interior view of the fixed vanes that are mounted about the circular interior of the housing.

Another modification is shown in FIGS. 5, 6 and 7. The housing 120 has a shaft 122 suitably mounted in bearings one of which is shown at 124.

Rotor 126 is keyed to shaft 122. Vanes 128 surround the periphery of rotor 126. A second freely rotatable rotor 130 has a hub 132 mounted on sleeve 134 which is freely rotatable on shaft 122. Hub 132 is also in free rotatable relation with spacer 136 and the wall 138 of housing 120.

The outer periphery of rotor 130 carries a cylindrical flange portion 140 which is radially aligned with vanes 128 of fixed rotor 126. Portion 140 carries interior vanes 142 and exterior vanes 144. The interior vanes 142 shown in section in FIG. 6 are closely adjacent vanes 128 on the fixed rotor. The exterior vanes 144 could be like the interior vanes 142 but as shown in FIGS. 5 and 6 they are in the form of cylindrical holes drilled diagonally part way through portion 140 at uniform intervals.

Steam nozzle 146 directs steam tangentially at vanes 128 of rotor 126 and steam nozzle 148 directs steam at vanes 144 of rotor 130. Both rotors rotate in the same direction.

The exterior of the cylindrical flange portion 140 is closely adjacent vanes 150 which are fixed to the circular interior of housing 138. Vanes 150 are in the form of short square pins arising from the interior housing surface. See FIGS. 6 and 7. These pins have proven to be effective as steam engaging means.

FIGS. 5 and 6 disclose another modification in the form of diagonal ports 152 and 154 extending from the apex of every other vane 142 outwardly and rearwardly through the cylindrical portion 140 of rotor 130. These two rows of ports are on opposite sides of vanes 144.

In the operation of this form of the invention steam is delivered from nozzle 146 to put fixed rotor 126 into operation. Simultaneously steam from nozzle 148 puts free rotor 130 in motion in the same direction. The steam from nozzle 146 initially applies its kinetic forces to vanes 128. Thereafter, the steam expands to apply a forward force against vanes 128 and a backward force against the advancing vanes 142 on free rotor 130. Similarly, expanding steam from nozzle 148 acts against the advancing vanes 144 and the fixed vanes 150.

The ports 152 and 154 provide passages through which higher pressure steam may travel from space 156 between vanes 128 and 142 to the space 158 between vanes 144 and 150 and continuing on to impinge against fixed vanes 150. The inclusion of ports 152 and 154 is believed to make more efficient use of the higher pressure steam from nozzle 146.

Figure 9:
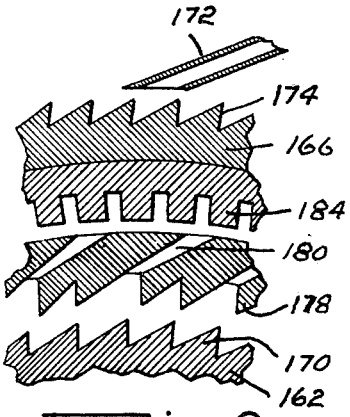
FIG. 9 is an enlarged fragmentary section taken on the line 9—9 of FIG. 8.
Figure 8:
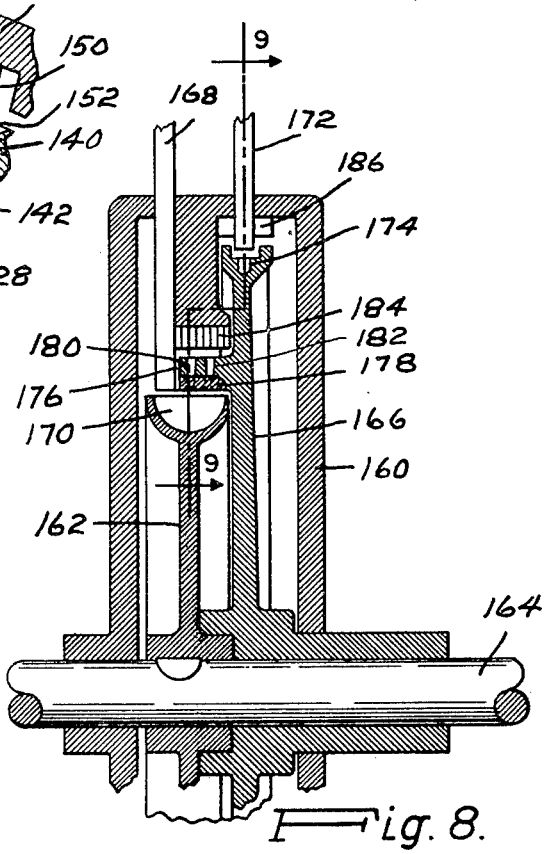
FIG. 8 is another modification similar in principle to FIG. 5 but with the free rotor of increased radius to provide a greater lever arm for the steam to act against.

Still another species is shown in FIGS. 8 and 9. This construction is generally similar to the construction of FIG. 5. There is a housing 160, a fixed rotor 162 on shaft 164 and a freely rotating rotor 166 on the shaft.

Steam nozzle 168 delivers steam against vanes 170 and steam nozzle 172 delivers steam against vanes 174.

Rotor 166 has a circular flange like extension 176 which extends over the vanes 170 of rotor 162. Extension 176 includes vanes 178 on its inner side in close relation with vanes 170.

Extension 176 also includes two rows of diagonal ports 180 and 182. Surrounding the outer side of extension 176 are fixed circumferential vanes 184 and surrounding vanes 174 are fixed circumferential vanes 186.

It will also be noted in FIGS. 8 and 9 that the lever arm of free rotor 166 is substantially longer than the lever arm of rotor 162 thereby to improve the leverage of the steam from nozzle 172 against rotor 166.

Expanding steam from nozzle 168 acts against the moving vanes 170 and the advancing vanes 178 of rotor 166. Some of the steam from nozzle 168 flow outwardly through ports 180 and 182 to act against fixed vanes 184.

Expanding steam from nozzle 172 acts against vanes 174 on rotor 166 and fixed vanes 186 on the housing interior.

In brief summary of all of the species disclosed, the turbine housing contains at least two rotors. One rotor is connected directly to the shaft. The other rotor is free to rotate on the shaft. The fixed rotor has one set of vanes subject to steam from a first steam nozzle. The free rotor has two sets of vanes, one set being closely adjacent the vanes on the first fixed rotor and the other set of vanes being closely adjacent fixed vanes on the turbine housing. The incoming steam from the two nozzles drives the rotors first by striking the vanes directly and thereafter by expansion of the steam acting on the relatively advancing vanes of the fixed rotor in relation to the vanes on the free rotor and the advancing vanes on the free rotor in relation to the fixed vanes on the housing. Ports through the circular part of the free rotor may be included whereby higher pressure steam from the fixed rotor nozzle may flow outwardly to engage against the fixed vanes on the housing.

It is to be understood that the vanes on the rotors and the housing in any of the species disclosed herein may take the form of any vanes usable in the turbine art and the particular forms disclosed herein are not to be considered as limiting in the claims.

The above disclosure will suggest to others skilled in the art modifications which are within the scope of the invention as defined by the appended claims.

I claim:

1. A steam turbine comprising a housing,
a rotatable shaft carried by said housing,
a first rotor within said housing mounted on and fixed to said shaft,
a second rotor within said housing mounted for free rotation on said shaft,
a first set of steam engaging vanes on said first rotor,
a second set of steam engaging vanes on said second rotor which said second set of vanes are closely adjacent the vanes of said first rotor,
a first steam nozzle for supplying steam to act on the said first and second sets of vanes,
a third set of steam engaging vanes on said second rotor,
a fourth set of steam engaging vanes arranged circumferentially about the interior of said housing, said fourth set of vanes being closely adjacent said third set of vanes, and
a second steam nozzle for supplying steam to act on the said third and fourth sets of vanes whereby both said rotors will be driven in the same direction.

2. The construction set forth in claim 1,
the first and second steam nozzles aimed principally at said first and third sets of vanes.

3. The construction set forth in claim 1,
and means for preventing mingling of the steam from said first and second steam nozzles.

4. The construction set forth in claim 1,
and means for controlling the steam delivered from said first and second nozzles whereby the relative speeds of said rotors can be controlled.

5. The construction set forth in claim 1,
said first and second sets of vanes being along side each other and said third and fourth sets of vanes being along side each other.

6. The construction set forth in claim 1,
said first set of vanes surrounding said second set of vanes and said fourth set of vanes surrounding said third set of vanes.

7. The construction set forth in claim 1,
the said first set of vanes being surrounded by said second set of vanes and said third set of vanes being surrounded by said fourth set of vanes.

8. The construction set forth in claim 7, and ports extending through said second rotor whereby some of the steam from said first steam nozzle can be directed in a non radial backward direction against said fourth set of vanes.

9. The construction set forth in claim 7, said first and second sets of vanes being axially offset with respect to said third and fourth sets of vanes.

10. The construction set forth in claim 9, and ports extending through said second rotor whereby some of the steam from said first steam nozzle can be directed in a non radial backward direction against said fixed vanes.

11. The construction set forth in claim 1, and ports extending through said second rotor whereby some of the steam from said first steam nozzle can be directed in a non radial backward direction against said vanes fixed on the interior of said housing.

12. The construction set forth in claim 11, said ports commencing at positions between the vanes of said second set of vanes and terminating close to said fixed vanes.

13. The construction set forth in claim 11, there being two rows of ports with the third set of vanes located therebetween.

14. The construction set forth in claim 12, there being two rows of ports with the third set of vanes located between the outer ends of said ports.

15. The construction set forth in claim 11, the radius of said second rotor being substantially greater than the radius of said first rotor, the fixed vanes on said housing that are opposite the outer ends of said ports being located radially inwardly of the outer periphery of said second rotor.

16. The construction set forth in claim 15, and another set of vanes fixed to said housing that are opposite the third set of vanes on said second rotor.

* * * * *